US005722845A

United States Patent [19]

Debortoli et al.

[11] Patent Number: 5,722,845

[45] Date of Patent: Mar. 3, 1998

[54] ELECTRICAL CONNECTORS

[75] Inventors: George Debortoli, Ottawa; Bhu Pendra Patel, Aylmer; Kent Stahn, Oreleans, all of Canada

[73] Assignee: Northern Telecom Limited, Montreal, Canada

[21] Appl. No.: 719,302

[22] Filed: Sep. 19, 1996

[51] Int. Cl.[6] ..... H01R 11/22

[52] U.S. Cl. ..... 439/267

[58] Field of Search ..... 439/260, 262, 439/267

[56] References Cited

U.S. PATENT DOCUMENTS 4,498,717 2/1985 Reimer ..... 439/62

4,636,019 1/1987 Gillett et al. ..... 439/260

5,171,154 12/1992 Casciotti et al. ..... 439/260

*Primary Examiner*—Neil Abrams

*Assistant Examiner*—T. C. Patel

*Attorney, Agent, or Firm*—R. J. Austin

[57] ABSTRACT

An electronic shelf having a back plane and side walls which are themselves printed circuit boards in communication with the back plane. Each side walls has connectors which may be opened for the sliding reception of an edge card into the shelf, the connectors then being closed to make electrical contact with the edge cards through terminals in the connector. Each connector has flexible conductors to permit opening and closing of the connector and conveniently the flexible conductors are provided by a flexible cable. Use of flexible cable permits minimizing distances between conductors and terminals. Also covered is an electrical connecor with specific features suitable for its use upon a side wall of the shelf.

9 Claims, 5 Drawing Sheets

ELECTRICAL CONNECTORS

This invention relates to electrical connectors and is particularly concerned with electrical connectors for use in the electronic industry, especially for use with electronic shelf structures for containing edge cards.

In electronic shelf structures, printed circuit boards, conventionally of the type known as edge cards, are guided through frontal openings of the shelves into receiving stations in which the edge cards lie in parallel and side-by-side relationship and are connected at their rear ends to other printed circuit boards of the shelves and which are commonly referred to as "back planes".

As progress is being continually made in electronic circuitry design, the above type of electrical arrangement is now found to be becoming limiting on circuitry design as back planes are being found to be inadequate for the electrical and electronic needs of the industry. There is therefore an outstanding need for basic improvements to be made so as to allow for more electrical and electronic design freedom within the confines of the physical design of a shelf structure.

The present invention provides an electrical connector which may be used to alleviate the above problem when used in shelf structure designs and also may have other uses to provide electrical connection advantages.

According to the present invention there is provided an electrical connector comprising an assembly of: an elongate rigid support; a row of flexible conductors, each having at one end a first terminal spaced outwardly from one side of the support and disposed at one side of a receiving station for an edge region of a printed circuit board to be received in the receiving station, the first terminals being spaced apart longitudinally of the support and the conductors having second terminals spaced along the conductors from the first terminals, the second terminals for connection to terminals of a further electrical member; a guide carried by the rigid support for removably locating the edge region of the printed circuit board in the receiving station with a surface of the board at the edge region in a position opposing the first terminals; and means carried by the rigid support for flexibly moving the conductors between positions in which the first terminals are simultaneously in operational locations for electrically engaging other terminals on the surface of the printed circuit board and non-operational locations in which the first terminals are simultaneously spaced from and are electrically disengaged from the terminals of the printed circuit board.

With the above construction, the first terminals are moved away from the operational positions so as to enable the printed circuit board to be inserted into the receiving station by movement along the guide. Hence, with the first terminals moved out of position, no contact takes place between the terminals of the board and the first terminals of the connector whereby no damage can result during board insertion. A connector of the design according to the invention therefore may be used for location upon forwardly extending walls of an electronic shelf and with the printed circuit board during its insertion into the receiving station having its terminals moved longitudinally past the first terminals until an operational position of the printed circuit board is obtained. When the printed circuit board is in its operational position, then the first terminals of the conductors are moved into their operational locations in which each of the first terminals makes electrical contact with a corresponding terminal on the surface of the printed circuit board in the receiving station.

As may be seen, the electrical connector according to the invention may therefore be used while enabling the forwardly extending wall of the shelf to be provided as a forwardly extending printed circuit board which provides an extension for the back plane of the shelf. Thus the area for circuitry design of the back plane is increased significantly by the circuitry in the forwardly extending printed circuit board. Also, operator design freedom is provided for the circuitry of the board to be inserted into the receiving station. In a preferred arrangement, both opposing forwardly extending walls of the shelf are provided as printed circuit boards with each of the forwardly extending printed circuit boards having an electrical connector according to the invention for location at each side for guiding and holding a printed circuit board in the receiving station. Hence with the latter particular construction, both of the forwardly extending printed circuit boards form extensions of the printed circuit board design of the back plane. The construction of the electronic shelf is such that the opposing walls which form the forwardly extending printed circuit boards may be vertically extending side walls or top and bottom horizontal side walls of the shelf. Thus the printed circuit boards to be inserted in the receiving stations are either held in the station horizontally or vertically as the case may be.

In a preferred arrangement, the means for flexibly moving the conductors to move the first terminals, between the operational and non-operational locations applies a gripping force to an edge region of the printed circuit board when this is in the receiving station. This gripping force has the effect not only of holding the printed circuit board accurately in its desired location for connection to the first terminals, as is necessary, but also insures that a positive contact is provided between the first terminals and the terminals on the edge region of the printed circuit board in the receiving station.

The conductors may be individual conductors having their individual terminals mounted in terminal connections at the two ends of the conductors. With this type of mechanical arrangement, however, the minimum distance between the terminals of the conductors would be severely restricted because of the size of the terminal locations. However, in a particularly preferred construction, the flexible conductors are provided by a flexible printed circuit board with the conductors extending side-by-side through the printed circuit board; the means for flexibly moving the conductors is operable to flex the flexible printed circuit board to move the first terminals between their operational and non-operational positions. Hence, with this latter construction, the conductors are provided by circuitry paths in the flexible printed circuit board and, with such an arrangement, the terminal positions may have significantly reduced distances apart longitudinally of the electrical connector and, more suitably, these distances correspond to desired distances apart of the terminals of conductor paths on the printed circuit board to be received in the receiving station. It follows therefore that with the use of a flexible printed circuit board on the electrical connector, there is provided an added flexibility in circuitry design between the printed circuit board to be received in the receiving station and the forwardly extending printed circuit board which assists in increasing the density of the circuitry in the total finished construction.

Hence, as may be seen from the above, the electrical connector of the invention provides for greater circuitry design scope in electronic shelf design and also with the preferred arrangements incorporating flexible printed circuit boards in electrical connectors, enables optimal circuitry design density to be provided in the shelf design.

The invention also includes an assembly of a first printed circuit board and an electrical connector in which the electrical connector comprises: an elongate support; a row of flexible conductors, each having at one end a first terminal spaced outwardly from one side of the support and disposed at one side of a receiving station for an edge region of a second printed circuit board to be received in the receiving station, the first terminals being spaced apart longitudinally of the support; a guide carried by the rigid support for removably locating the edge region of the second printed circuit board with a surface of the edge region of the second printed circuit board in a position opposing the first terminals; and means carried by the rigid support for flexibly moving the conductors between positions in which the first terminals are simultaneously in operational positions for electrically engaging terminals on the surface of the edge region of the second printed circuit board, and in non-operational positions in which the first terminals are simultaneously electrically disengaged from the terminals on the edge region of the second printed circuit board; the electrical connector being mounted upon the first printed circuit board with the conductors having second terminals spaced along the conductors from the first terminals, the second terminals being electrically engaged with terminals upon the first printed circuit board.

The latter structure, according to the invention, is one which may form part of a shelf with the first printed circuit board being provided by a forwardly extending wall of the shelf. Hence all the advantages relating to the extension of the electronic circuitry in the back plane along the forwardly extending wall of the shelf are obtained as referred to above.

With the structure having the rigid support actually mounted upon the first printed circuit board, it is preferable to provide freedom for movement of the rigid support upon the first printed circuit board and between set limits of movement. This movement, which is permitted by the flexibility of the electrical conductors, is of particular use when the plurality of electrical connectors are mounted upon a printed circuit board extending forwardly of a shelf from the back plane so as to accommodate any warpage or non-planarity of the board.

The invention further includes an electronic shelf for receiving printed circuit boards in receiving stations in a volumetric shelf space within the shelf, the shelf comprising a back plane extending across the rear of the shelf and walls extending forwardly from the back plane and defining a frontal opening to the shelf space, a pair of the walls being located in opposition across the shelf space and carrying guide means for sliding reception of the edge regions of the printed circuit boards to be received in the receiving stations with at least one of the opposing walls being provided by a forwardly extending printed circuit board connected electrically to the back plane, and each guide means carried by the forwardly extending printed circuit board is provided by an electrical connector also having: an elongate rigid support; a row of flexible conductors, each having a first terminal spaced outwardly from one side of the support and disposed at one side of a corresponding receiving station for an edge region of the printed circuit board to be received in the receiving station, the first terminals being spaced apart longitudinally of the support; and means carried by the rigid support for flexibly moving the conductors between positions in which the first terminals are simultaneously in operational locations for electrically engaging terminals on the surface of the edge region of the board to be received in the receiving station and in non-operational locations in which the first terminals are simultaneously electrically disengaged from the terminals on the edge region; the connector being mounted upon the forwardly extending printed circuit board and the conductors having second terminals spaced along the conductors from the first terminals, the second terminals being electrically engaged with terminals upon the forwardly extending printed circuit board.

Further, the invention includes a combination of printed circuit boards and connectors in which two opposing spaced apart primary boards have an intermediate printed circuit board extending between them and carried by electrical connectors at edges of the intermediate printed circuit board to each of the primary circuit boards, the electrical connectors being as defined above with regard to the present invention.

Embodiments of the invention will now be described, by way of example, with reference to the accompanying drawings, in which:

FIG. 1 is a diagrammatic isometric view of electronic shelf according to a first embodiment and showing a printed circuit board received in a receiving station;

FIG. 2 to a much larger scale than FIG. 1 is an isometric view in the same direction as FIG. 1 of an electrical connector used in the shelf of the first embodiment;

Figure 1:
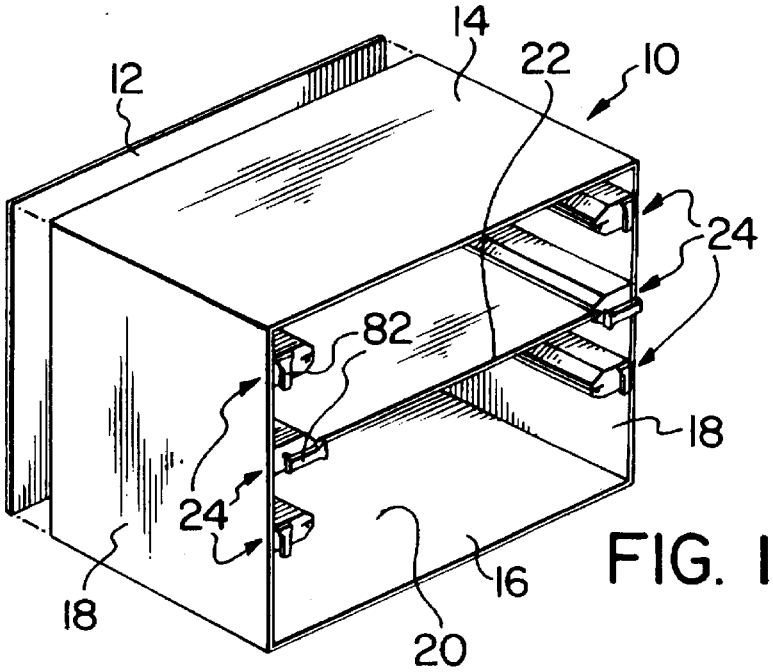
Figure 2:
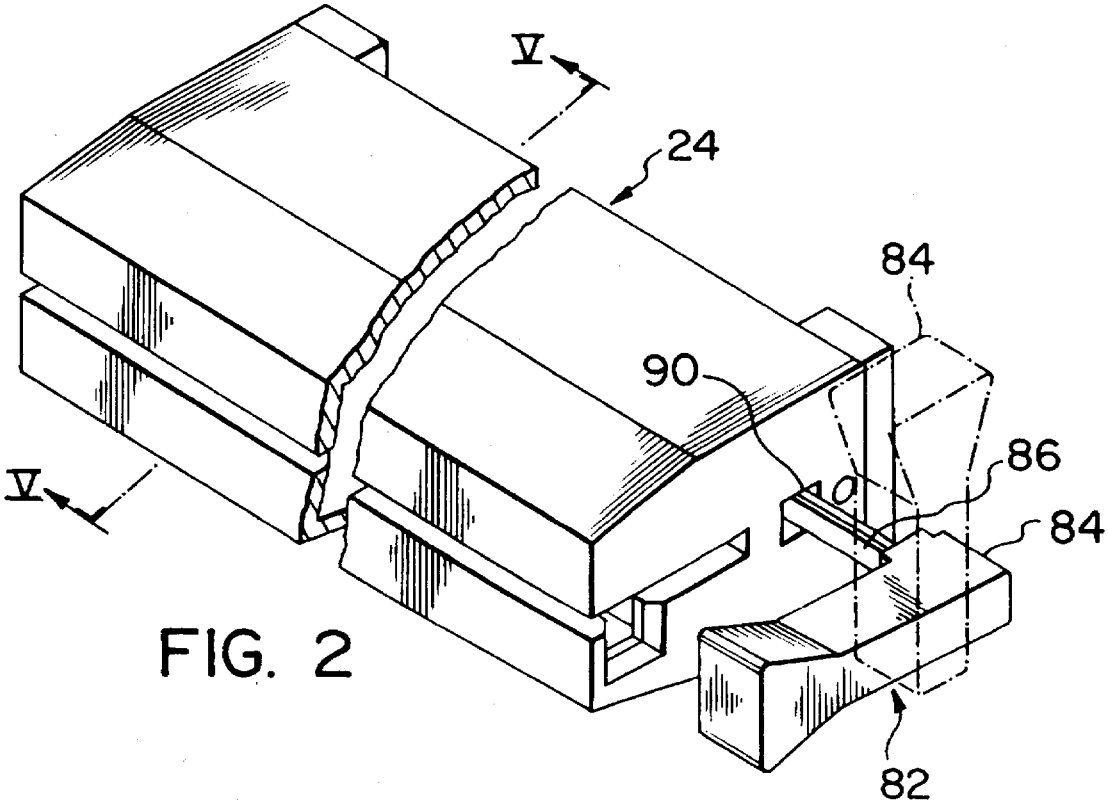
Figure 3:
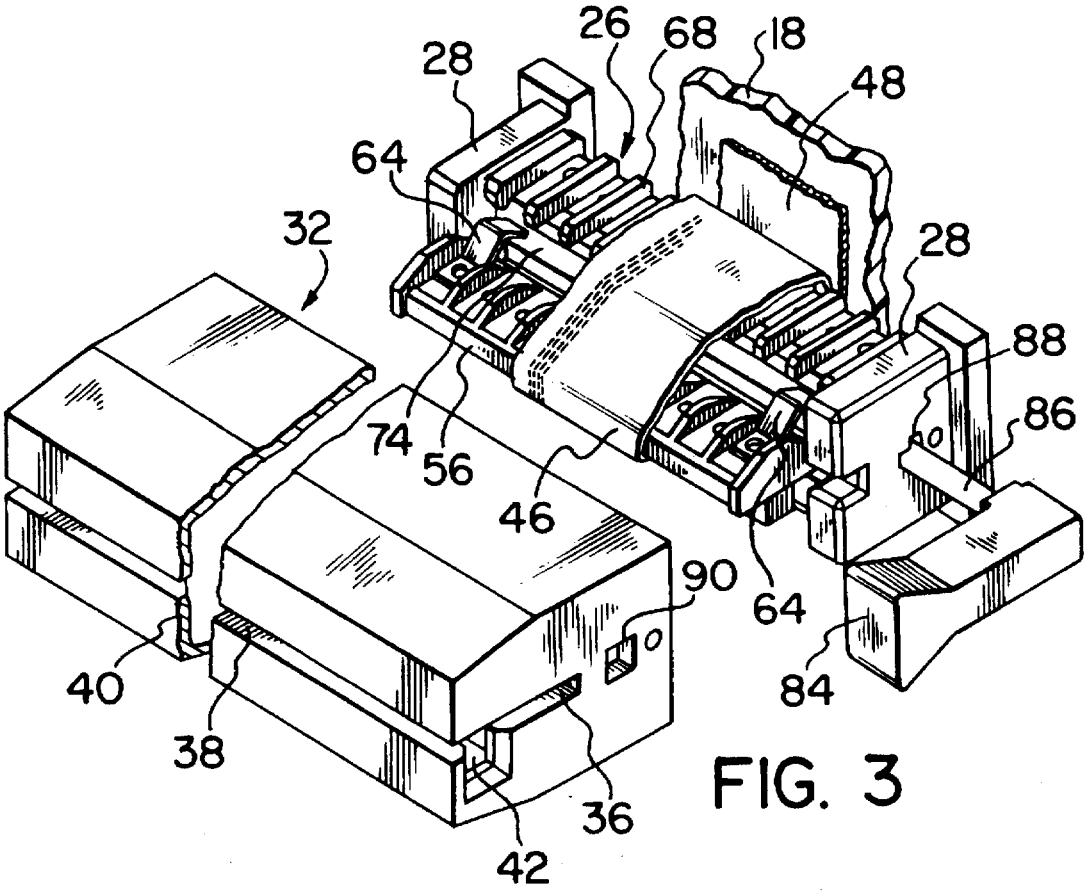
FIG. 3 is a view similar to FIG. 2 showing the electrical connector partially exploded.
Figure 4:
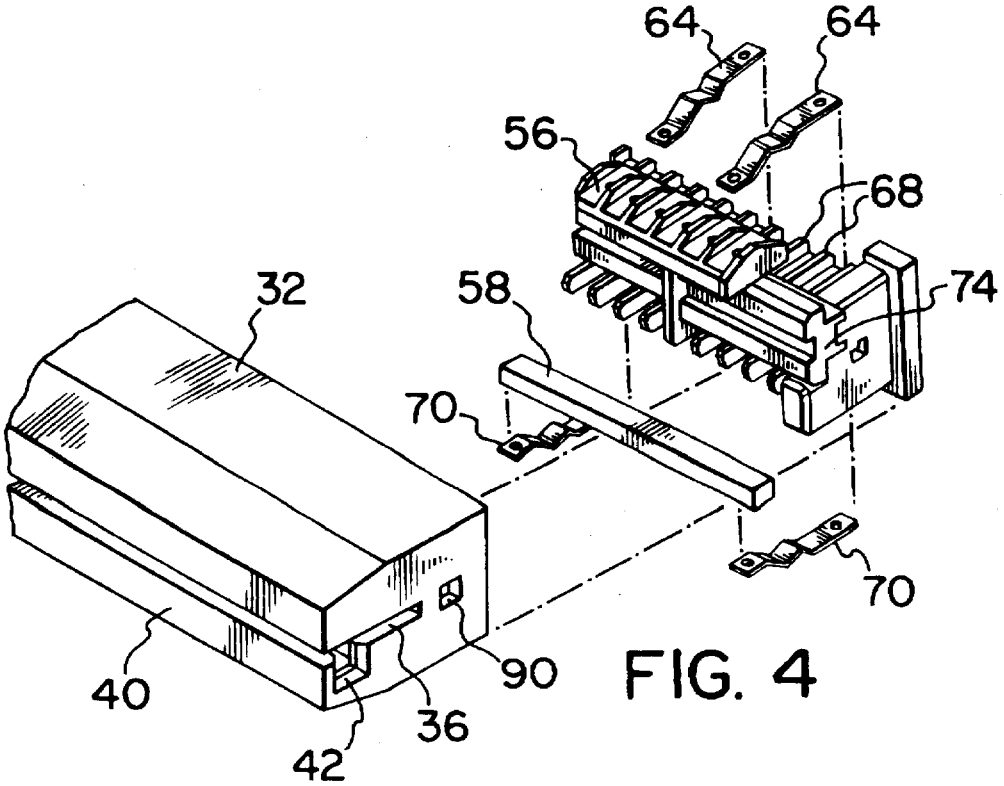
FIG. 4 is a view similar to but smaller than FIG. 2 showing the connector fully exploded.

In a first embodiment as shown in FIG. 1, an electronic shelf 10 for containing edge cards comprises a back plane 12 in the form of a printed circuit board as is conventional. The shelf also has top and bottom walls 14 and 16 extending forwardly from the back plane and forwardly extending side walls 18. The top and bottom walls 14 and 16 and side walls 18 define a frontal opening 20 for insertion of printed circuit board to be accommodated in the shelf.

A basic distinction between the shelf 10 and conventional shelves is that each of the side walls 18 is itself a printed circuit board which is electrically connected into the circuitry of the back plane 10 and hence increases the area for electrical circuitry of the back plane 12. In addition, each of the printed circuit boards to be inserted into the shelf, i.e., edge cards 22, is electrically connected at its edge regions to the circuitry in the printed circuit boards of the side walls 18. Hence the edge cards lie horizontally when in receiving stations within the shelf instead of vertically as is conventional.

In order to be able to assemble the edge cards in the above-described manner with electrical connections into the printed circuit boards 18, electrical connectors 24 are mounted upon each of the printed circuit boards 18. As shown by FIG. 1, each of the electrical connectors 24 is of elongate construction and extends from the frontal opening 20 to a position adjacent the back plane 12. Connectors 24 on each printed circuit board 18 are horizontally aligned with corresponding connectors 24 on the other printed circuit board so as to provide pairs of horizontally spaced connectors. Each pair of connectors is provided to guide an edge card 22 into the shelf and to hold it correctly in position when in the receiving station. The connectors 24 on each printed circuit board are identical. The construction of an electrical connector 24 on one of the boards will now be described with the understanding that the electrical connectors on the other board 18 are of opposite hand.

As shown in FIGS. 2, 3, 4 and 5 particularly, each of the electrical connectors 24 comprises an elongate rigid support 26. At each end, the rigid support 26 is provided with a mounting position 28 by which it is loosely mounted to its respective printed circuit board 18 by screws 30 passing through from the outside of the printed circuit board 18. The screws 30 are slideably received within complimentary holes in the printed circuit board to prevent any lateral movement, i.e., vertically, of the support 26 but allow for horizontal movement of the support towards and away from the printed circuit board 18.

For the purpose of the sliding reception of an associated edge card 22 into its receiving station in the shelf, the electrical connector is provided with a guide which is carried by the rigid support. This guide is defined by an open sided housing 32 of the connector, the housing being elongate so as to extend laterally over the rigid support 26 and cover the support while the side to be secured to the printed circuit board 18 remains open for attachment thereto. The housing 32 has ends 34 each formed with a horizontal guide slot 36 for an edge card 22, the two slots 36 being joined by an elongate end to end guide slot 38 formed in a front face 40 of the housing 32. For laterally positioning the edge card 22 with respect to the connector 24, each of the slots 36 is formed with a lateral depending slot 42 which accommodates and guides a longitudinally extending rib 44 extending along the edge region of the edge card 22 as shown, for instance, by FIGS. 7 and 8.

Figure 5:
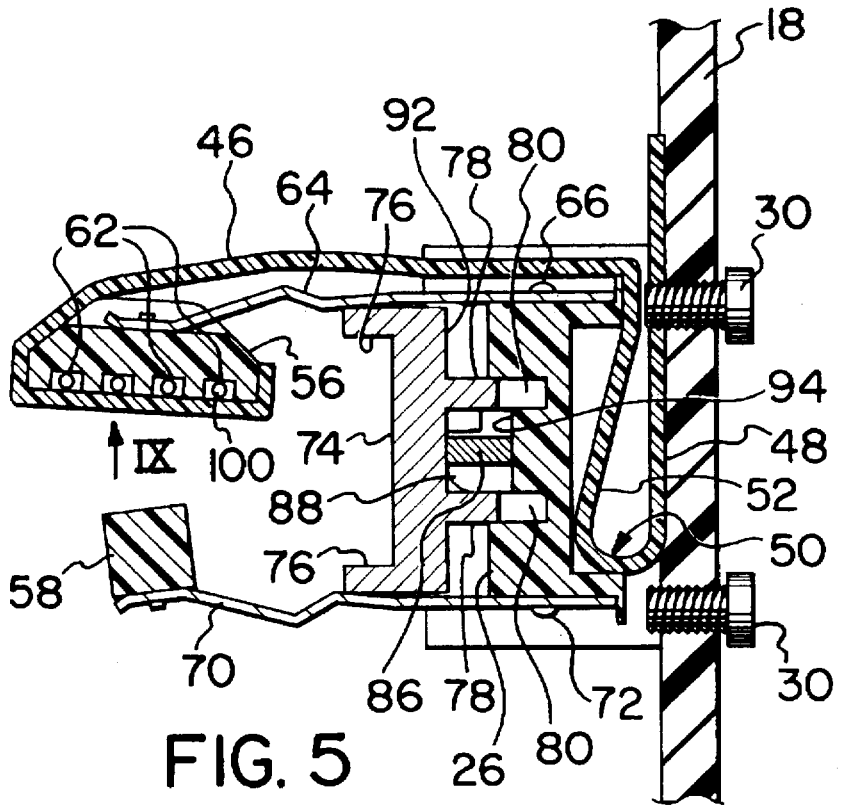
FIG. 5 is a cross-sectional view through the connector taken along Line V—V in FIG. 2 and showing terminals of conductors in non-operational locations and with a housing of the connector removed.

As will now be described, the electrical connector 24 has a plurality of electrical conductors having terminals electrically connected to terminals of the associated printed circuit board 18 and other terminals for connection to the associated edge card 22 to be inserted into the connector. These electrical conductors are flexible and are provided by electrical paths forming part of a flexible printed circuit board 46 (see FIGS. 3 and 5 to 8). FIG. 5, in which the cover 32 is omitted, most clearly shows the arrangement of the flexible printed circuit board 46 and associated features. One planar end portion 48 of the flexible printed circuit board 46 extends down the inner surface of the printed circuit board 18 and the terminals of the boards 18 and 46 are soldered together. The planar portion 48 forms part of a flexed U-shaped part 50 of the flexible printed circuit board, the other leg 52 of which extends to the top of the rigid support. The flexible printed circuit board then continues in a substantially horizontal fashion towards the front face 40 of the cover 32 and then downwardly to provide a planar end portion 54 of the circuit board. This planar end portion 54 has its lower surface facing downwardly towards the receiving station of the connector for the edge card 22, the receiving station defined, of course, by the guide slots 36 and 38. As will be described in more detail below, the end portion 54 of the printed circuit board locates the terminals of the conductors at the edge portion 54 for connection to the terminals of the edge card 22.

To enable the edge card to be moved into and out of the shelf while preventing the terminals of the edge card and of the flexible printed circuit board 46 from sliding across each other, it is necessary to move the end portion 54 of the board 46 between operational and non-operational positions. This performed by providing a means for flexing the board 46 between these two positions. This means comprises a pair of gripping jaws in the form of an upper gripping jaw 56 and a lower gripping jaw 58. The upper gripping jaw 56 is secured to the flexible board 46 with the planar portion 54 retained against a planar under surface of the jaw 56, the surface 60 being formed with four parallel longitudinally extending groves 62 for purposes to be described. The jaws 56 and 58 are disposed in opposition one on each side of the receiving station and are relatively moveable together either towards the receiving station in order to permit the terminals in the portion 54 to occupy the operational position (FIG. 8) or to move the portion 54 into the non-operational position as shown for instance in FIGS. 5 and 7. This movement is accommodated by the use of a cantilever spring means and a spring position control member. For the upper jaw 56, the cantilever spring means comprises a plurality of individual cantilever springs 64, secured at a fixed end by screws 66 to the rigid support 26 and extending substantially horizontally towards the front face 40 of the housing 32 with free ends of the springs carrying the jaw 56. Thus, the springs extend laterally of the elongate jaw and lie parallel to each other while being spaced in the longitudinal direction of the rigid support 26. This may be seen from FIGS. 3 and 4 in which the individual springs 64 are separated by short walls 68 of the support. Similarly the jaw 58 is held at the free ends of cantilever springs 70 which are similarly attached by screws 72 to a lower side of the rigid support 26.

Figure 6:
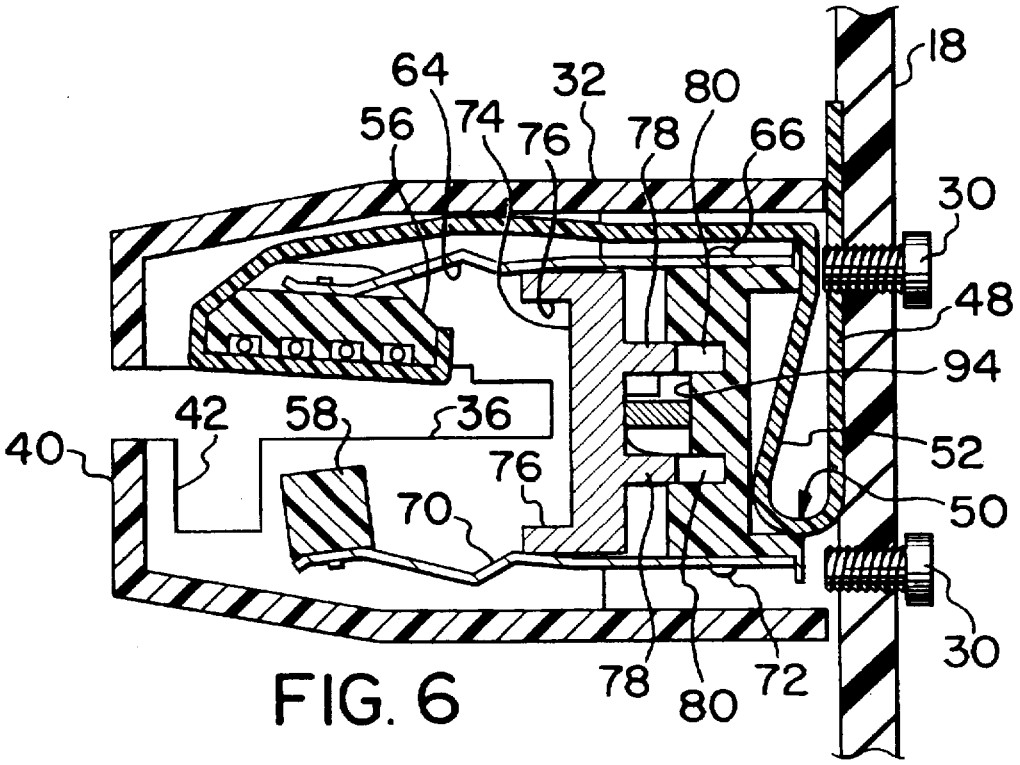
FIG. 6 is a view similar to FIG. 5 with the housing in position.
Figure 7:
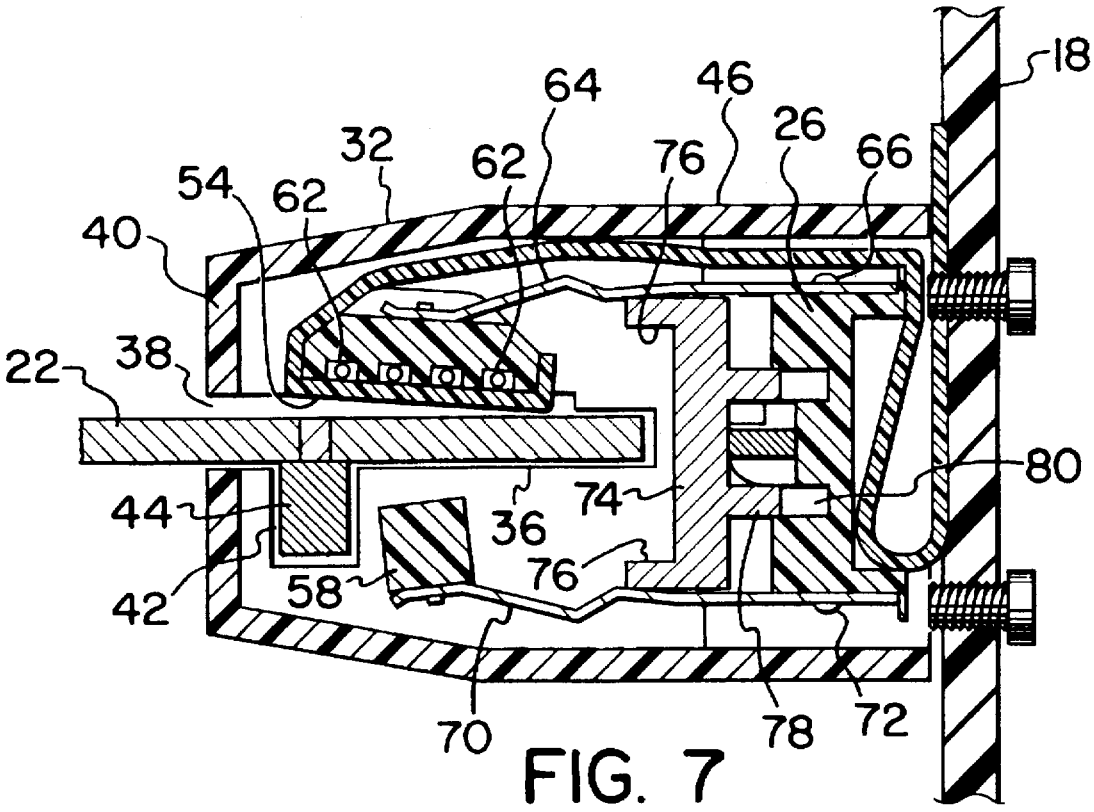
FIG. 7 is a view similar to FIG. 6 showing a printed circuit board located within a receiving station.
Figure 8:
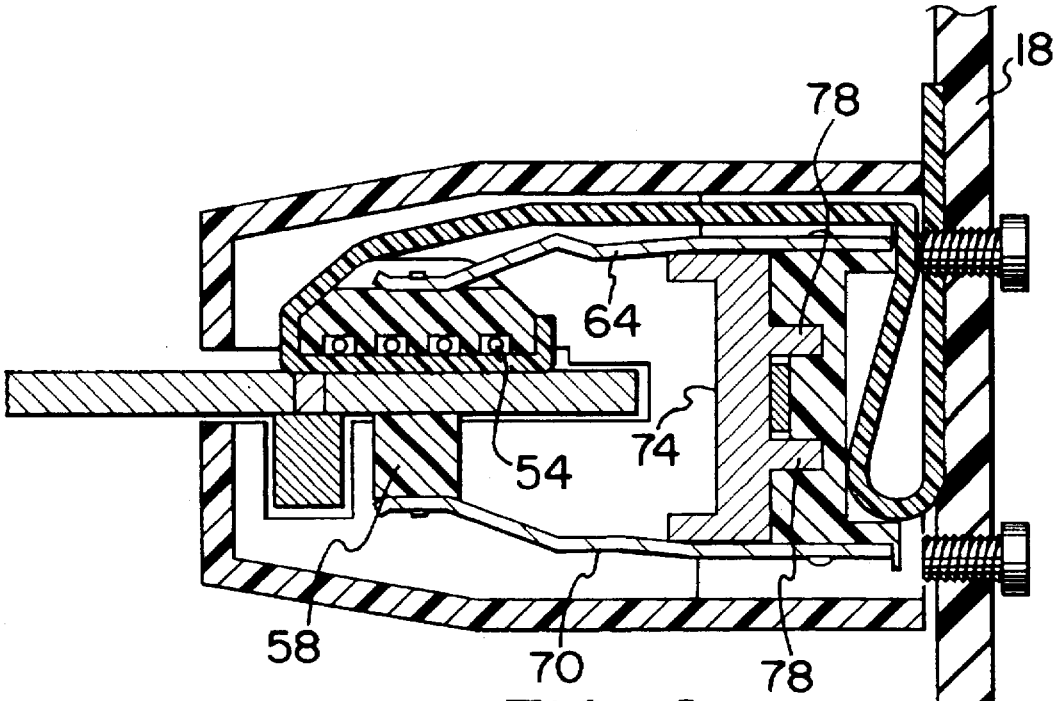
FIG. 8 is a view similar to FIG. 7 showing the connector terminals in operational locations upon the printed circuit board.

The spring position control member comprises a longitudinally extending spring actuation block 74 (see FIGS. 5 to 8 in particular). This spring actuator block 74 has upper and lower horizontally extending arms 76 for engaging lower and upper surfaces respectively of the springs 64 and 70. The block 74 is slideably received for horizontal movement by the rigid support 26 by reception of two guide ribs 78 of the actuator block in corresponding guide slots 80 of the support 26. The force of the springs 64 and 70 is such as to move the actuator block towards the right, as shown in FIG. 8, and into a retracted position in which these springs resiliently move the jaws 56 and 58 towards to the receiving station, i.e., with the terminals in the edge portion 54 of the flexible board 46 in their operational positions. However, to control the movement and position of the block 74, a manually operated key 82 is provided as shown particularly by FIGS. 2 and 3. The key 82 has an operating handle 84 and elongate actuating bar 86 which extends from end to end of the rigid support 26 by being received within suitably shaped apertures 88 in the ends of the support 26 for the function of moving the block 74 which the key is to perform. The bar 86 is also received through a rectangular aperture 90 in each end 34 of the cover 32. As more clearly shown in FIGS. 5 to 8, the actuator bar 86 is a rectangular cross-section and permanently engages a rear vertically extending surface 92 of the actuator block 74. The key is rotatable about 90° between the position shown in FIG. 5 with the bar 86 horizontal and the position shown in FIG. 8 with the bar in a vertical position. During this movement the bar 86 acts between the rear surface 92 of the actuator block and a surface 94 of each of the apertures 88. With the bar in the vertical position, shown in FIG. 8, the block 74 is moved towards the right under the force of the springs 64 and 70 whereas during movement of the bar to its horizontal position (for instance see FIG. 5), the actuator block 74 is moved towards to the left into a position in which it operates the jaws 56 and 58 to move them away from the receiving station.

It will be appreciated that this invention as discussed in this particular embodiment enables the use of a flexible printed circuit board to connect its cards to the printed circuit boards 18 extending forwardly and providing extensions of the back plane. With this form of an arrangement while using the flexible printed circuit board, then the distance between the conductor paths of both printed circuit boards 18 and 46 and thus of the conductor terminal positions in the planar portions 54 of the board may be minimized in accordance with conventional printed circuit board designs.

Figure 9:
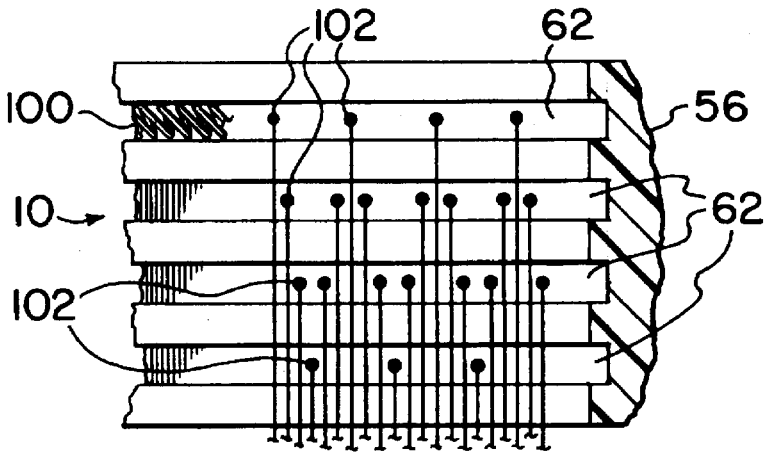
FIG. 9 is an enlargement of part of the connector taken in the direction of arrow IX in as FIG. 5.

With a small pitch between the terminals in the planar portion 54 of the flexible board 46, a problem could be found in ensuring that all of these terminals contact the corresponding terminals on the surface of the edge card 22. However, the first embodiment overcomes this problem in the following manner. Each of the grooves 62 accommodates a spiral spring 100 which extends from end to end of the groove. As shown in FIG. 9, (which shows only spring 100), the terminals 102 for the flexible board 46 in the portion 54 may be provided in any desirable and relative positions. As may seen from FIG. 9 the terminals 102 are disposed in a particular desired pattern with each of the terminals overlying the opening to a respective groove 62. The spiral spring 100 within that groove has a particular convolution shape of its spirals with the spring operating between the base of the groove and the conductors 101 and terminals 102 to urge them towards the edge card 22 when this is in the receiving station. The convolutions 103 of the springs 100 are shaped so as to resiliently compress in a radial direction of each spring under lateral pressure thereby providing the force necessary to urge the conductors 101 and terminals 102 towards the edge card 22. The convolutions are oriented, as shown more clearly by FIG. 10, so that the parts of the convolutions closest to the planar portion 54 of the board 46 are inclined so as to overlap each other in the spring longitudinal direction. With this coil convolution configuration, it is ensured that the spring must act effectively against the conductors 101 and the terminals 102 to ensure that each conductors terminal is pressed against the edge card. As may be seen from FIG. 11, effectively each of the conductors in the planar portion 54 is acted against by at least two convolutions of the spring at different longitudinal positions of the conductor path. It has been found that with this arrangement all of the terminal 102 successfully make point contact with the terminals on the edge card 22.

In use of the shelf and the electrical connectors 24, before an edge card 22 is inserted into its receiving station, each of the electrical connectors for holding the edge card is in a position as shown by FIGS. 5 and 6 with the clamps 56 and 58 moved away from each other. In this position the springs 64 and 70 are held apart by the actuation block 74 by virtue of the rotational position of the bar 86. In this position the handle 84 of the key 82 is in a vertical position as shown by chain dotted outline in FIG. 2, so as not to obstruct the slots 36, 38 and 42. The edge card 22 is then inserted into the receiving station by sliding movement of the edge card with the guide rib 44 on each side sliding along its respective slot 42. After its final position of movement into the receiving station, then the arrangement of the parts is shown as in FIG. 7. The key 82 is then rotated to bring the actuator bar 86 into its vertical position. At this time the actuator block 74 is moved towards the right by the force of the springs 64 and 66. The jaws 56 and 58 move towards each other (FIG. 8) to bring the terminals 102 into their operational positions in which they are electrically engaged precisely with the associated terminals on the upper surface of the edge card 22. The edge card is located accurately in position by a stop (not shown) at the rear end of the connector. The gripping force of the jaws 56 and 58 ensures a positively maintained electrically engaging contact between the terminals 102 and those on the edge card 22. As may be seen, the ribs 44 at each edge region of the board serve as lateral location and registration for aligning the terminals 102 laterally across the shelf with the terminals on the edge card 22. This is because each rib 44 is received in sliding engagement with its groove 42. The gap between groove 42 and rib 44 is purely diagrammatic for the purpose of more clearly showing the features. In the event that the printed circuit board 18 is not exactly planar but has some warpage, then the engagement of the rib 44 within the slot 42 at that side of the shelf will cause relative movement of the electrical connector 24 laterally with regard to the board 18. This is allowed for by the sliding reception of the screws 30 within the board and also by the flexible nature of the U-shaped portions 48 and 52 of the flexible board 46.

It follows therefore that the electrical connector according to the invention and as described in the embodiment is particularly useful for enabling an edge card to be inserted into a shelf while preventing engagement of the conductors between the connector and the edge card until the edge card is accurately located in the receiving station. Clearly the terminals 102 are moved completely out of their operational positions so that substantial clearance is provided between the edge card 22 and those terminals as is indicated by FIG. 7. In addition to this of course, the electrical connector is particularly suitable for use with a flexible printed circuit board as in the above described embodiment. Therefore because of the density of the connections available between the edge card and each circuit board 18 through the connector, then the edge card serves as an extension of the printed circuit board 18 while the terminal and conductor density from edge card to each printed circuit board 18 is comparable to that which may be present from the board 18. In addition, not only is the edge card located exactly in its desired position from front to rear of the shelf, but the guide arrangement between each rib 44 and its slot 42 ensures lateral alignment of the terminals 102 with those on the edge card so that complete accuracy in registration of the board is guaranteed.

Figure 10:
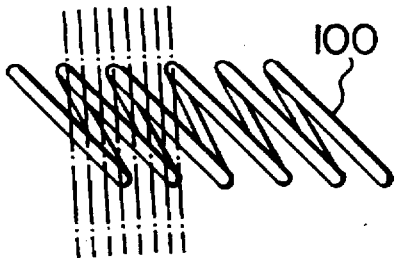
FIG. 10 is a view similar to FIG. 9 and to a much larger scale.
Figure 11:
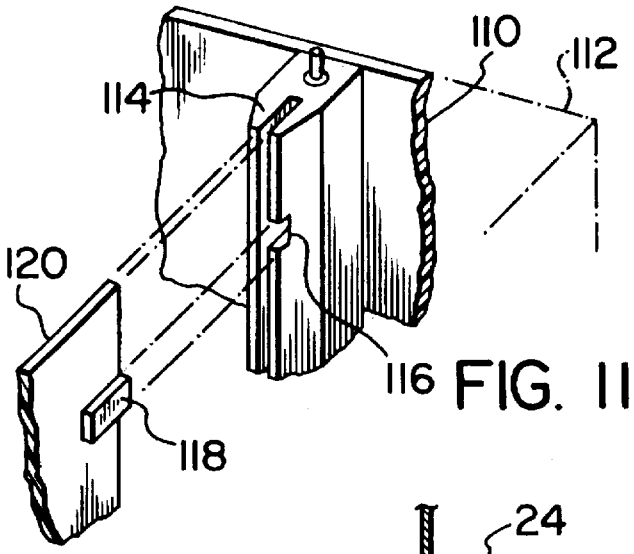
FIG. 11 is a view similar to FIG. 2 of an electrical connector forming a second embodiment with the connector mounted upon a back plane.

The invention is also applicable to the use of electrical connectors upon the back plane itself of a shelf. For instance, as shown by FIG. 11, to a back plane 110 in a shelf 112 has a plurality of vertical connectors 114 which are fundamentally of the same design as the connectors 24. Parts not shown in FIG. 10 are referred to by the reference numerals in the first embodiment. However, the connectors 114 differs from the connectors 24 in that a guide slot 42 in not required. This guide slot is replaced by one or more guide slots 116 which extend from the front face 40 towards to the actuator block 74. This slot 116 accommodates a guide block 118 provided upon a vertical edge card 120 which is to move into the shelf and to be located in the connector 114. The guide slot 116 and guide block 118 locate the edge card 120 in a vertical direction relative to the connector 114 so as to correctly align the terminals 102 of the flexible board 46 with the respective terminals on a surface of the board. With this arrangement, some stop means (not shown) may be provided at the base of the slot 36 for contacting the edge of the edge card 120 to locate the edge card laterally in correct position within the connector 114.

In a modification (not shown) of either of the first and second embodiments, the gripping jaw 58 is replaced with another jaw 56 and another flexible board 46 is incorporated on the other side of the receiving station. This may involve some change in connector design. For instance, the U-shaped portions of the flexible boards 46 are less deep than in the first embodiment so as to prevent their mutual interference. With this arrangement, in the modification, many more electrical connections are made possible between the edge card and the printed circuit boards 18 thereby further intensifying the circuitry design of the total shelf and edge card assembly.

Figure 12:
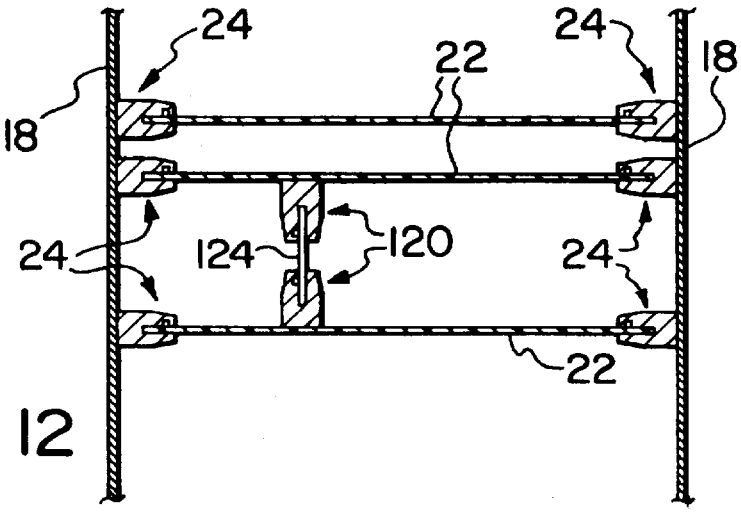
FIG. 12 is a front view of a shelf according to a third embodiment.

In a third embodiment as shown by FIG. 12 which diagrammatically illustrates a front view of a shelf with some edge cards 22 assembled, each of the edge cards is contained between side wall printed circuit boards 18 by respective connectors 24. In addition to this, certain of the edge cards 22 are provided with other connectors 120 of similar construction to the connectors 24. These connectors 120 are placed in such positions that they oppose each other, when edge cards 22 are in their receiving stations, and receive intermediate printed circuit boards 124 possibly of narrower width then the edge cards 22. These circuit boards 124 are connected by terminals at their edges through terminals in flexible printed circuit boards in the connectors 120 with the circuitry in each of the associated edge card 22. By this arrangement therefore, the intermediate printed circuit boards 124 provide a direct connection between the circuitries of the edge cards 22 without the need for the connection to be made through either of the boards 18. With this type of arrangement, as may be seen, circuitry in each of the boards 124 removes the need for certain circuitry in one or both of the boards 18 thereby providing more board area for other circuitry design.

What is claimed is:

1. An electrical connector comprising as an assembly:—an elongate rigid support:

a flexible printed circuit board having a row of flexible conductors each having at one end a first terminal spaced outwardly from one side of the support and disposed at one side of a receiving station for an edge region of a rigid printed circuit board to be received in the receiving station, the first terminals being spaced apart longitudinally of the support and the conductors having second terminals spaced along the conductors from the first terminals for connection to terminals of a further electrical member;

a guide carried by the rigid support for removably locating the edge region of the rigid printed circuit board in the receiving station with a surface of that board at the edge region in a position opposing the first terminals;

and a pair of gripping jaws, the jaws disposed in positions, one of each side of the receiving station, a first of the gripping jaws carrying an end region of the flexible printed circuit board with the first terminals held by the first gripping jaw facing towards the receiving station, and the first gripping jaw is mounted at the free end of a cantilever spring means which is secured at its other end to the rigid support, and a spring position control member is slidably movably supported by the rigid support between:

a) a retracted position in which the cantilever spring means holds the first gripping jaw towards the receiving station for a gripping action upon the rigid printed circuit board and in which the flexible printed circuit board is flexed to locate and hold the first terminals simultaneously in operational positions for electrically engaging other terminals on the surface of the rigid printed circuit board; and b) another position to operate the first gripping jaw to hold it away from the receiving station and in which the flexible printed circuit board is flexed to locate the first terminals spaced from and electrically disengaged from the rigid printed circuit board terminals.

2. A connector according claim 1 wherein each of the gripping jaws is mounted at the free end of a cantilever spring means which is secured at its other end to the rigid support, and in the retracted position of the spring position control member both cantilever spring means hold the gripping jaws towards the receiving station for a gripping action and in the other position of the spring position control member, the spring position control member operates both gripping jaws to hold them away from the receiving station.

3. An electrical connector according to claim 1 wherein an operating member is provided and is operably connected to the spring position control member for moving the spring position control member from its retracted position to its other position, the operating member being elongate and extending longitudinally of the support and being pivotable around an axis of the operating member and having a cam surface to act against the spring position control member with cam action so as to cause the spring position control member to move to the other position upon pivoting of the operating member in an appropriate manner.

4. A connector according to claim 1 wherein an elongate housing extends over the assembly, the housing defining the receiving station and the guide for removably locating the edge region of the rigid printed circuit board.

5. A connector according to claim 4 wherein the guide extends longitudinally of the rigid support to guide the edge region of the rigid printed circuit board longitudinally of the rigid support.

6. A connector according to claim 4 wherein the guide extends laterally of the rigid support to guide the edge region of the rigid printed circuit board laterally of the rigid support.

7. A connector according to claim 1 wherein the first gripping jaw is provided with a longitudinally extending groove containing a coil spring and the flexible printed circuit board extends across the groove with the first terminals in line with openings to the grooves, and with the first gripping jaw moved towards the receiving station, the coil spring acts between the base of the groove and the first set of terminals to urge these terminals against the other terminals on the surface of the rigid printed circuit board, the coil spring having convolutions parts of which face in the direction of the first terminals and are oriented so as overlap from one convolution to another laterally of the longitudinal direction of the spring whereby each conductor end portion is crossed by part of at least two convolutions of the spring.

8. A connector according to claim 7 provided with a plurality of grooves each containing a coil spring and the end portions of the conductors have terminals some of which are in alignment with one groove opening and others of which are alignment with another groove opening.

9. An electrical connector comprising, as an assembly:

an elongate rigid support;

a flexible printed circuit board having a row of flexible conductors each having at one end a first terminal spaced outwardly from one side of the support and disposed at one side of a receiving station for an edge region of a rigid printed circuit board to be received in the receiving station, the first terminals being spaced apart longitudinally of the support and the conductors having second terminals spaced along the conductors from the first terminals for connection to terminals of a further electrical member;

a guide carried by the rigid support for removably locating the edge region of the printed circuit board in the receiving station with the surface of that board at the edge region in a position opposing the first terminals;

and means carried by the rigid support for flexibly moving the conductors between positions in which the first terminals are simultaneously in operational locations for electrically engaging other terminals on the surface of the rigid printed circuit board and non-operational locations in which the first terminals are simultaneously spaced from and are electrically disengaged from the rigid printed circuit board terminals, the means for flexibly moving the conductors having an operating member which has a cam surface operationally connected to the means for flexibly moving the conductors, the operating member being pivotable around an axis of the operating member to effect flexible movement of the conductors between the positions in which the terminals are in their operational locations and the positions in which the terminals are in their non-operational locations.

* * * * *